US005169231A

United States Patent [19]

Suzuki

[11] Patent Number: 5,169,231

[45] Date of Patent: Dec. 8, 1992

[54] APPARATUS FOR BLENDING BOILED RICE AND VINEGAR AND PREPARING VINEGARED RICE

[76] Inventor: Kisaku Suzuki, 19-8, Toshida 1-Chome, Nerima-Ku, Tokyo, Japan

[21] Appl. No.: 719,705

[22] Filed: Jun. 27, 1991

[51] Int. Cl.[5] ..... B01F 13/02

[52] U.S. Cl. ..... 366/105; 366/225; 34/130; 68/25; 99/348

[58] Field of Search ..... 99/323.4, 323.5, 348; 68/20, 25, 144; 34/130, 131, 139, 140; 134/119; 366/102, 103, 105, 219, 220, 225, 228, 229

[56] References Cited

U.S. PATENT DOCUMENTS

| | | | |
|---|---|---|---|
| 2,212,560 | 8/1940 | Foley | 68/20 |
| 2,782,622 | 2/1957 | Candor | 68/25 |
| 2,816,429 | 12/1957 | Kurlancheek | 68/25 |
| 3,132,846 | 5/1964 | Siddall | 366/105 |
| 3,302,608 | 2/1967 | Coons et al. | 366/220 |

FOREIGN PATENT DOCUMENTS

| | | | |
|---|---|---|---|
| 230966 | 5/1959 | Australia | 68/25 |
| 1317482 | 12/1989 | Japan | 68/20 |
| 2209190 | 8/1990 | Japan | 68/25 |

*Primary Examiner*—Harvey C. Hornsby
*Assistant Examiner*—Mark Spisich
*Attorney, Agent, or Firm*—Fred Philpitt

[57] ABSTRACT

An apparatus for blending boiled rice and vinegar including a rotatable agitating vessel which is mounted so as to be positioned to face both upwards and sideways. A blower is provided to blow air into the vessel when it is facing sideways to further aid in blending the ingredients.

1 Claim, 3 Drawing Sheets

APPARATUS FOR BLENDING BOILED RICE AND VINEGAR AND PREPARING VINEGARED RICE

BACKGROUND OF THE INVENTION

The present invention relates to an apparatus for preparing a shari (sushi rice, namely, vinegared rice) by blending a boiled rice and vinegar in a rotating blender on blending vessel.

There are many kinds of sushi and the most popular sushi is nigiri-zushi. The nigiri-zushi is made by hand-pressing a ball of shari or vinegared rice shaping up in a predetermined shape, and then a neta (for example, a piece of tuna, cuttlefish, octopus, and mackerel and the like) is placed on the pressed ball of shari.

The shari or vinegared rice is prepared by steaming boiled rice, quickly transferring it to a wooden vessel (called fune), sprinkling a vinegar on the steamed rice, and finally blending the rice and a vinegar by using a wooden spoon.

It is necessary to quickly cool the surfaces of the rice grains by blowing them strongly using a fan in order to glaze the rice. That is, excess water around the surfaces of the rice grains is blown away in order to cool them, thus thin films of starch are made on the surfaces. Consequently, glazed shari that is not sticky is obtained.

Nowadays, as described above, vinegared rice has been prepared by hands.

It is apparent that all works for preparing vinegared rice adapted to be used to make the nigirizushi are done by hands, blending the boiled rice and a vinegar and blowing the blended mix. Consequently, it is troublesome and it has been almost impossible to mass-produce the vinegared rice.

SUMMARY OF THE INVENTION

The present invention has been developed to solve the troublesome disadvantage mentioned above. Accordingly, it is first purpose of the present invention to provide an apparatus for blending a boiled rice and a vinegar and preparing a glazed and tasteful vinegared rice without difficulty, by introducing boiled rice and a vinegar into a blending vessel, automatically rotating the vessel, as well as blowing air into the vessel while rotating, using a blower.

It is a second purpose of the present invention to provide an apparatus for sufficiently separating the rice in the rotating blending vessel into pieces, and blending uniformly the rice with a vinegar in order to prepare a vinegared rice by means of a blending or agitating member provided with a number of mixing or agitating bars situated in the blending vessel.

It is a third purpose of the present invention to provide an apparatus for preparing a vinegared rice, which comprises a supporting frame and operable by a wheel, a supporting ring containing the blending or agitating vessel, the ring being held in the supporting frame so as to cross the front end of the supporting frame, and a plurality of rollers which come into contact with the outside of the vessel to rotatably support it, so that the blending or agitating vessel can smoothly rotate while it is in a reversed condition.

It is a fourth purpose of the present invention to provide an apparatus for preparing a vinegared rice, which has a L-shaped swivelable air blowing pipe installed on the blower in order to divert air when it is not used.

The apparatus for blending or agitating a boiled rice and vinegar and preparing vinegared rice according to the present invention comprises, in order to attain the first purpose above, a pair of columns, respectively erected opposedly on the both sides of a base of the apparatus, a cylindrical blending or agitating vessel provided with a blending or agitating member installed therein and a lid provided with a central opening for blowing and exhaling air, the lid being adapted to be applied on the top opening of the blending or agitating vessel, a supporting frame for rotating the vessel around its vertical axis and turning it around its horizontal axis, and a blower provided with a blowing pipe, which pipe having an exhaling opening portion applied to a front end of the blowing pipe and placed near the central opening for blowing in and exhaling air from the lid.

In order to attain the second purpose of the present invention, the apparatus for blending or agitating boiled rice and vinegar and preparing a vinegared rice according to the present invention comprises, in the apparatus for attaining the first purpose above, the blending, member contained in the blending vessel constructed of a circular holder inserted in the central opening of the blending vessel and held there, and a number of blending bars arranged in parallel along the right angle direction of the axis of the vessel and extending in directions along the axis of the vessel.

The apparatus for blending a boiled rice and vinegar and preparing a vinegared rice according to the present invention comprises in order to attain the third purpose, a supporting frame a supporting ring secured to the front ends of the frame and held in a manner that the supporting ring crosses the supporting frame, a blending or agitating vessel placed within the supporting ring, a drive shaft extruding from the bottom of the blending vessel and being journalled with the supporting frame, and a plurality of rollers secured on the front face of the supporting ring so as to make the upper circumferential face of the agitating or blending vessel come into contact with the rollers.

Furthermore, in order to attain the fourth purpose of the present invention, the apparatus for blending a boiled rice and vinegar preparing a vinegared rice comprises a blowing pipe of the blower shaped in an L shape, which pipe has a front exhaling opening made of swivelable for exhaling air to the side of the apparatus through the central blowing and exhaling opening of the lid of the blending vessel.

The operation of the apparatus according to the present invention will be explained.

First the wheel or handle is operated to hold the blending vessel in a position in which the opening or mouth faces upwardly. Then the lid of the blending vessel is removed, boiled rice and vinegar are placed in the blending vessel, and the lid is placed on the opening of the vessel.

Then the wheel is operated to turn the blending vessel so as to make its turning axis horizontal. By a motor driven and the agitating or blending vessel is rotated, the vinegared rice in the blending or agitating vessel tumbles within the vessel integrally with the vessel and strikes the rotating blending bars being scattered and uniformarily blended with vinegar liquid.

During such operation, the blower is simultaneously operated to blow air from the exhaling opening at the front end of the blowing pipe to the interior of the blending vessel through the central blowing and exhaling opening of the lid, then air circulates within the interior and is exhaled through the lid central opening.

As a result, surfaces of the vinegared rice grains are cooled and then films of starch are formed on the surfaces making glazed vinegared rice or shari.

When rice and vinegar are put in the blending vessel or vinegared rice is taken out of the vessel, the blowing pipe can be swiveled sideways.

EMBODIMENT OF THE INVENTION

Figure 1:
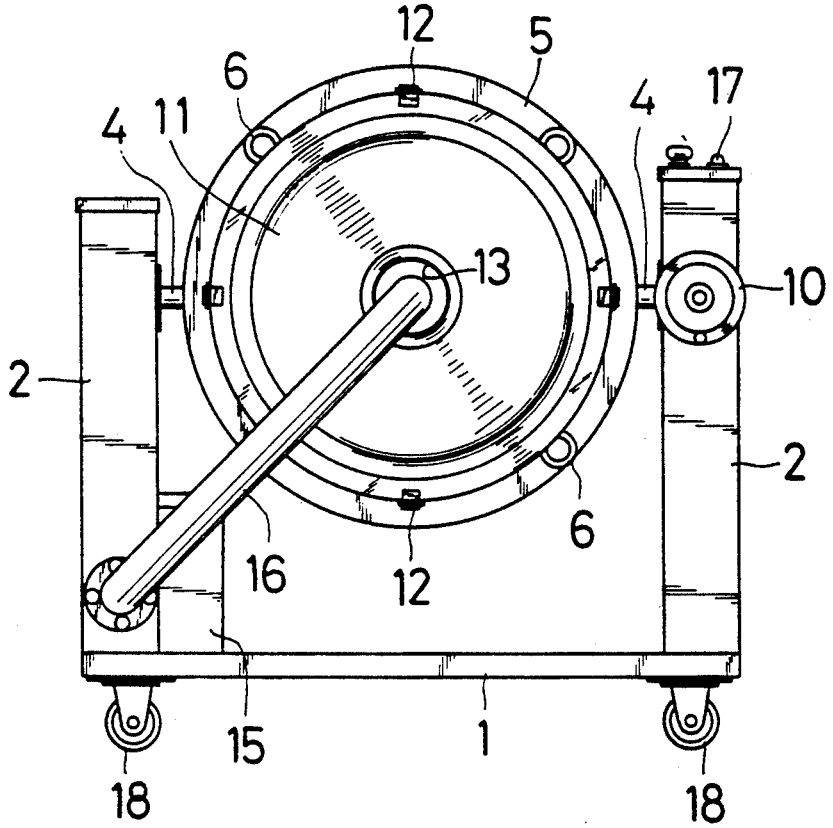
FIG. 1 is a front view of the apparatus for preparing vinegared rice according to the present invention.

An embodiment of the apparatus for blending boiled rice and vinegar in order to prepare vinegared rice or shari will be explained with reference to the accompanying drawings.

First two columns 2 and 2 are mounted opposedly on both sides of the upper portion of the base plate 1. Between these columns 2 and 2, a supporting shaft 4 extending from both sides of a supporting frame is rotatably journalled.

On the front end of the supporting frame 3, a circular ring 5 is secured so as to extend cross the supporting frame. A plurality of rotary rollers 6 (four rollers in the embodiment) are journalled on the front face of the supporting ring 5 at regular intervals.

The cylindrical blending vessel 7 is rotatably mounted within the supporting frame 3 and the supporting ring 5. In detail, a drive shaft 8 extending from the bottom central portion of the blending vessel 7 is journalled with the central portion of an inside surface of the supporting frame 3, as well as the upper circumferential portion of the vessel coming into contact with the rotary rollers on the supporting ring 5.

The drive shaft 8 extending from the bottom of the blending vessel 7 is joined to a motor within the drive box 9 secured to the outside of the supporting frame 3. The manual wheel 10 is secured to the outer end of one of the supporting shafts 4 of the supporting frame 3.

According to such construction of the apparatus of the present invention, driving the motor in the drive box 9 drives the blending vessel 7 as well as the rotary rollers 6 of the supporting ring 5 revolve around the vessel 7. While, rotating the wheel 10 turns the blending vessel 7 through the supporting shaft 4 integrally with the supporting frame 3 from its vertical posture at which the opening faces of the blending vessel 7 directly overhead to its horizontal posture at which the vessel crosses the drive shaft 8.

Figure 3:
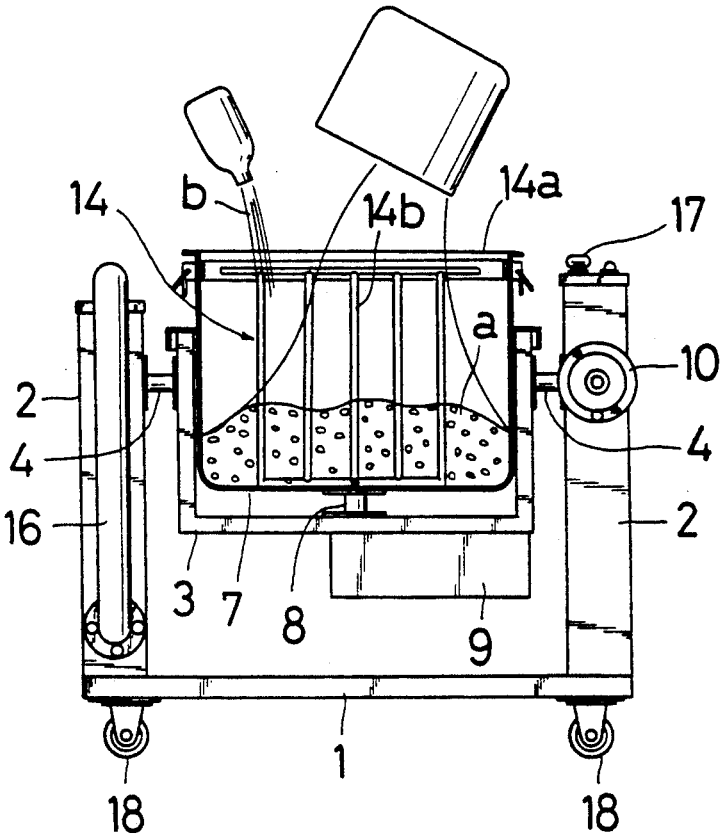
FIG. 3 is a partly-broken front view showing the condition of the blending vessel in which boiled rice and vinegar are placed.
Figure 4:
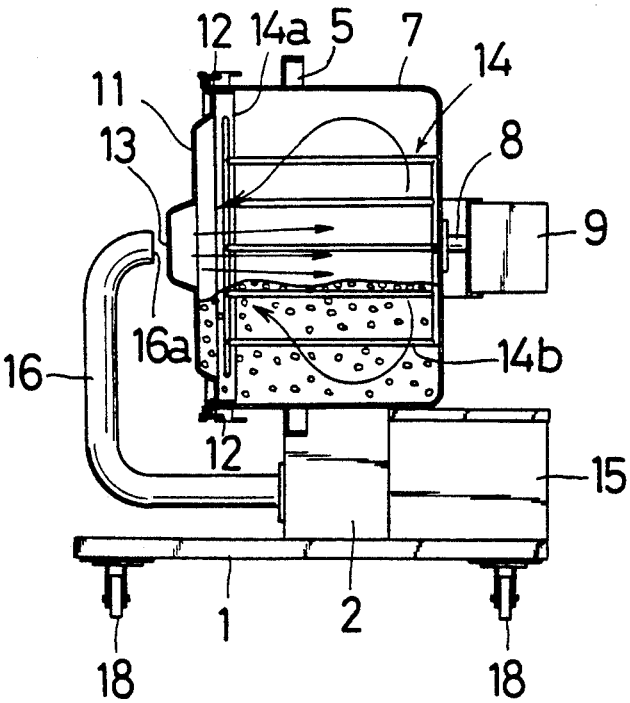
FIG. 4 is a partly-broken side view showing the condition in which air is blown into the agitating or blending vessel.

When a boiled rice (a) and a vinegar (b) are put in the blending vessel 7 as shown in FIG. 3, the blending vessel 7 is kept in its stable vertical condition. When the rice (a) and the vinegar (b) are mixed or blended after being put in the vessel 7, the vessel is turned forwardly through 90° and then rotates as shown in FIG. 4.

The lid 11 is removably secured to the top hole or opening of the blending vessel 7 by a fastening or locking device or fitting 12. It is noted that a blowing and exhaling or exhausting hole 13 is formed at the center of the lid 11. Around the exhaling hole 13, there is a tapered portion extending outside. As a result, any rice grain (a) in the rotating blending vessel 7 is prevented from being ejected out of the vessel through the exhaling hole 13.

Figure 5:
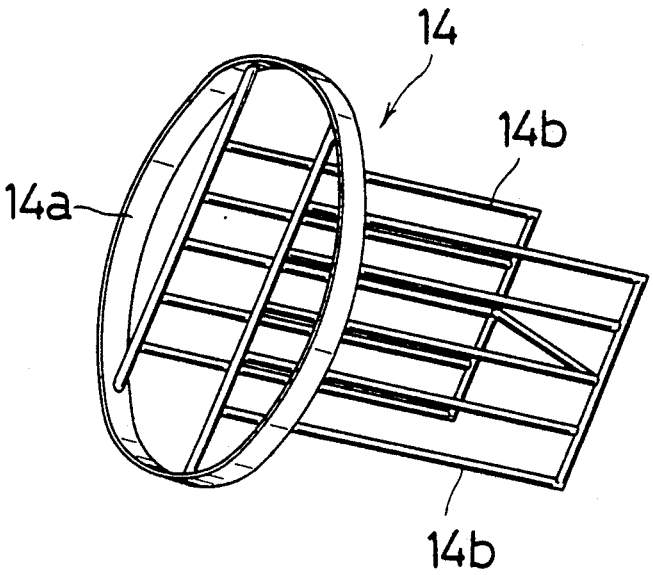
FIG. 5 is a perspective view of the agitating or blending member.
Figure 6:
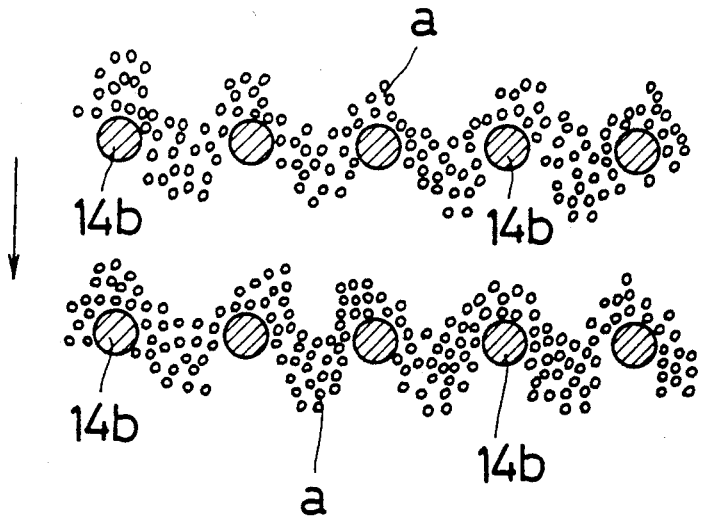
FIG. 6 is an enlarged section depicting the condition in which rice is blended by means of blending bars.

A blending or agitating member 14 is placed in the blending vessel 7, which can be taken out of the vessel. As shown in FIG. 5, the agitating member 14, consists of a circular holder **14*a* and a plurality of agitating or blending bars 14*b*. The circular holder 14*a* is adapted to be inserted in the agitating or blending vessel 7 placed in the hole of the agitating or blending vessel 7, and secured there. These blending bars 14*b* extend in parallel toward the bottom of the blending vessel 7 from the circular holder 14*a*. Consequently, the blending member 14 rotates together with the blending vessel 7, rice grains (a) rotate along the same direction when the blending member 14 rotates and down vertically, strike the blending bars 14*b*** during downward fall and are scattered or separated so as to be blended uniformly with vinegar (b).

Figure 2:
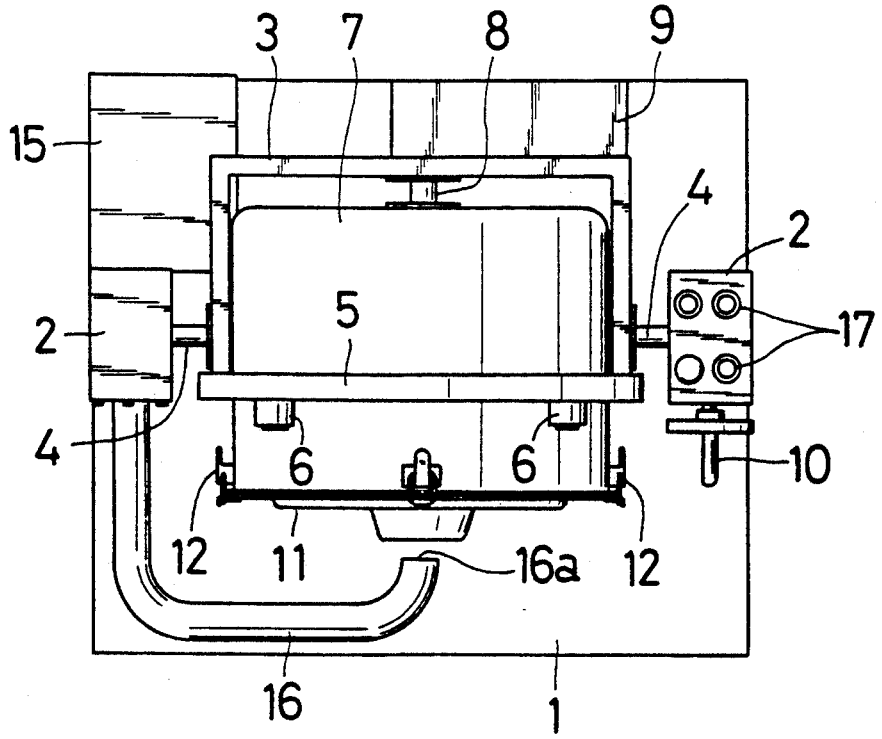
FIG. 2 is a plan view of the apparatus of FIG. 1.

The blower 15 is located on one side of the upper face of the base plate 1. The blowing pipe 16 shaped substantially in the form of a letter L is placed at the front face of the blower 15 so as to pass through the supporting column 2. The front end exhaling hole **16*a* of the blowing pipe 16 is placed, as shown in FIGS. 1, 2, and 4, during its operation, so as to face and be near the central blowing and exhaling opening 13 of the lid 11 of the blending vessel 7. When the blowing pipe 16 is not used, the base of the pipe 16 swivels and the pipe pivots sidewise as shown in FIG. 3. The outlet end of the blowing pipe 16 bends substantially at a right angle to make its outlet opening 16*a* face the blending vessel 7 in order to smoothly send air to the hole or opening 13 of the lid 11**.

The motor driving the blending vessel 7 and the blower 15 are operated by a switch button 17 placed on the upper face of the supporting column 2.

A set of rolling casters 18 are secured to the bottom face of the base plate 1.

An effect of the present invention will be described with reference to the embodiment above of the apparatus for blending a boiled rice and a vinegar and preparing vinegared rice.

Ingredients of a boiled rice and a vinegar can be easily charged into the blending vessel because when such ingredients are put into the vessel, the vessel is kept in a vertical position so as to face its opening upward while they are mixed in the vessel, the blending vessel is turned sideways so as to make the rotary axis horizontal and rotates, so that the rice in the vessel effectively rotates and drops downwardly and strikes the blending bars of the blending member, completely crushing up or scattering the rice.

In detail, the conventional blending device has a stationary vessel and a blending member rotating in the interior of the stationary vessel so as to forcibly mix the ingredients charged to the vessel, with the disadvantage that when the boiled rice is sticky or viscous, the sticky or soft rice grains are apt to be smashed resulting of a paste condition and changing their quality.

According to the present invention, not only the ingredients such as a boiled rice and a vinegar but also the blending vessel containing these ingredients integrally rotate, so that the rice rotates in the rotating blending vessel, as well as the rice falling in the space of the vessel by gravity, striking the blending bars of the blending member and being separated or scattered. As a result, few rice grains are smashed or deformed in the blending vessel and rice grains are uniformly blended with a vinegar, without making sticky vinegared rice.

In addition, because effective air blowing is attained from the central opening of the lid to the interior of the agitating vessel by the blower, the rice under agitation can be quickly cooled, and as a result, glazed vinegared rice is obtained without difficulty. The air blown in the agitating vessel circulates in the interior of the vessel and is exhaled through the central opening of the lid of the agitating vessel, so that it is possible to continuously send air to the agitating vessel.

Consequently, it is possible to carry out a preparation of vinegared rice automatically and effectively,

What is claimed is:

1. An apparatus for blending boiled rice and vinegar so as to obtain vinegared rice which comprises (a) a cylindrical agitating vessel (7) having an opening adapted to receive a quantity of rice and vinegar, (b) a supporting frame (3) for rotatably supporting said vessel (7), (c) rotating means (8, 9) for rotating said vessel (7), (d) a support structure (1, 2) for mounting said supporting frame (3) including means (4, 10) to rotate said supporting frame (3) through an angle of at least 90° so that said vessel (7) can be moved from a first position wherein said opening of the vessel faces upwardly to a second position wherein said opening of the vessel faces sideways, (e) a removable lid (11) for said vessel (7) having a central opening (13) wherein for the entrance and exit of air, (f) a blower (15) and associated blowing pipe (16) mounted on said support structure (1, 2) positioned so that the outlet of said blowing pipe (1 6) can be moved to and away from said opening (13) in said lid (11), (g) an array (14) of agitating bars (14*b*) positioned within said vessel (7), said agitating bars (14(*b*) extending parallel to each other and mounted to rotate with said vessel (7) when said vessel (7) is rotated above a horizontal axis by said rotating means (8, 9).

* * * * *